US009066599B1

(12) United States Patent
Waggoner

(10) Patent No.: US 9,066,599 B1
(45) Date of Patent: Jun. 30, 2015

(54) MATTRESS RESTORATION ASSEMBLY AND METHOD OF USE

(71) Applicant: Justin James Waggoner, Sioux Falls, SD (US)

(72) Inventor: Justin James Waggoner, Sioux Falls, SD (US)

( * ) Notice: Subject to any disclaimer, the term of this patent is extended or adjusted under 35 U.S.C. 154(b) by 0 days.

(21) Appl. No.: 14/181,883

(22) Filed: Feb. 17, 2014

(51) Int. Cl.

| | |
|---|---|
| ***A47C 27/00*** | (2006.01) |
| ***A47G 9/00*** | (2006.01) |
| ***A47C 27/15*** | (2006.01) |
| *A47C 27/14* | (2006.01) |
| *A61G 7/057* | (2006.01) |

(52) U.S. Cl.
CPC . *A47C 27/00* (2013.01); *A47G 9/00* (2013.01); *A47C 27/148* (2013.01); *A47C 27/144* (2013.01); *A61G 7/05715* (2013.01); *A47C 27/14* (2013.01); *A47C 27/15* (2013.01)

(58) Field of Classification Search
CPC ..... A47C 27/00–27/15; A47G 9/00; A61G 7/05715
See application file for complete search history.

(56) References Cited

U.S. PATENT DOCUMENTS

| | | | | |
|---|---|---|---|---|
| 3,751,742 | A * | 8/1973 | Worley | 5/659 |
| 4,745,645 | A | 5/1988 | McWilliams | |
| 5,070,559 | A | 12/1991 | Pettifer | |
| 5,502,855 | A | 4/1996 | Graebe | |
| 5,503,618 | A | 4/1996 | Rey | |
| 5,970,548 | A | 10/1999 | Welch | |
| 6,189,168 | B1 | 2/2001 | Graebe | |
| 6,460,209 | B1 | 10/2002 | Reeder et al. | |
| 6,871,369 | B1 | 3/2005 | Long | |
| D701,400 | S * | 3/2014 | Gregory | D6/606 |
| 2005/0172412 | A1 * | 8/2005 | Pearson | 5/659 |
| 2006/0117486 | A1 | 6/2006 | Clark et al. | |
| 2007/0000060 | A1 * | 1/2007 | Firestone | 5/659 |

* cited by examiner

*Primary Examiner* — Peter M Cuomo
*Assistant Examiner* — Brittany Wilson
(74) *Attorney, Agent, or Firm* — Mark A. Ekse

(57) ABSTRACT

A mattress restoration assembly and method of use for filling in impressions formed into the mattress to be restored, providing additional support and improving user comfort. The mattress restoration assembly includes a mattress abutting cover member positionable on the mattress to be restored, at least one support member operationally coupled to the mattress abutting cover member; a top cover member positioned over the mattress abutting cover member and the support member; and a securing means for selectively securing the mattress restoration assembly to the mattress.

11 Claims, 4 Drawing Sheets

MATTRESS RESTORATION ASSEMBLY AND METHOD OF USE

BACKGROUND OF THE INVENTION

1. Field of the Invention

The present invention relates to mattresses and mattress pads and more particularly pertains to a new Mattress Restoration Assembly and Method of Use for filling in body impressions formed in a mattress over time, to provide additional support, and to provide additional user comfort for worn mattresses.

2. Description of the Prior Art

The use of mattress pads and mattress repair systems is known in the prior art. More specifically, mattress repair systems heretofore devised and utilized are known to consist basically of familiar, expected and obvious structural configurations, notwithstanding the myriad of designs encompassed by the crowded prior art which have been developed for the fulfillment of countless objectives and requirements.

One such illustrative example is United States Patent Application Publication 2006/0117486, which requires a user to open up a mattress to be repaired, terminating any warranty, and to insert one or more inflatable bladders to provide additional support.

In these respects, the Mattress Restoration Assembly according to the present invention substantially departs from the conventional concepts and designs of the prior art, and in so doing provides an apparatus primarily developed for the purpose of providing additional support, filling in impressions caused by collapsed foam, padding or other support means.

SUMMARY OF THE INVENTION

In view of the foregoing disadvantages inherent in the known types of mattress repair systems now present in the prior art, the present invention provides a new Mattress Restoration System and Method of Use wherein the same can be utilized for filling in impressions formed in the mattress, provide additional support, and improve user comfort.

To attain this, the present invention generally comprises a mattress abutting cover member positionable on the mattress to be restored, at least one support member operationally coupled to the mattress abutting cover member; a top cover member positioned over the mattress abutting cover member and the support member; and a securing means for selectively securing the mattress restoration assembly to the mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to fill in impressions formed in the mattress over time with a new support member, such as a poly foam rather than trying to push a collapsed or failed foam support into position with an air bladder.

Another significant advantage of the present invention is the ability to fill in the impressions formed into the mattress and to provide additional support without voiding the warranty of the mattress.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
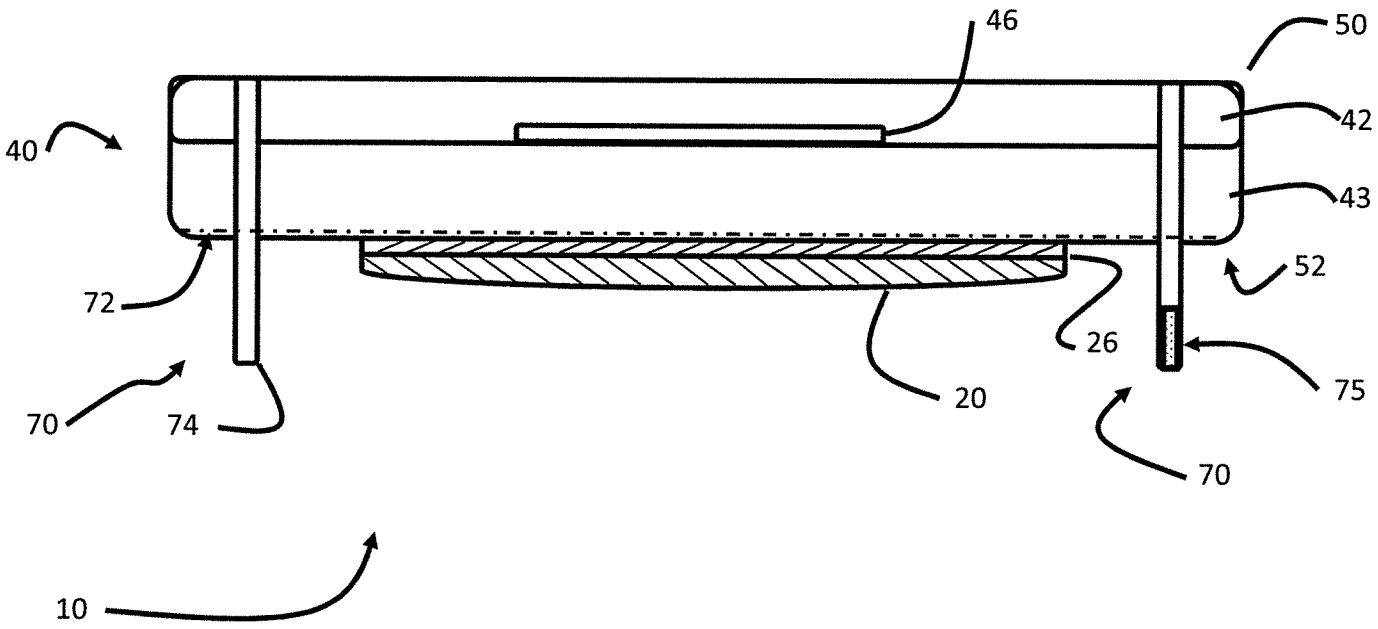
FIG. 1 is a schematic conceptual side view of a new mattress restoration assembly according to the present invention.
Figure 2:
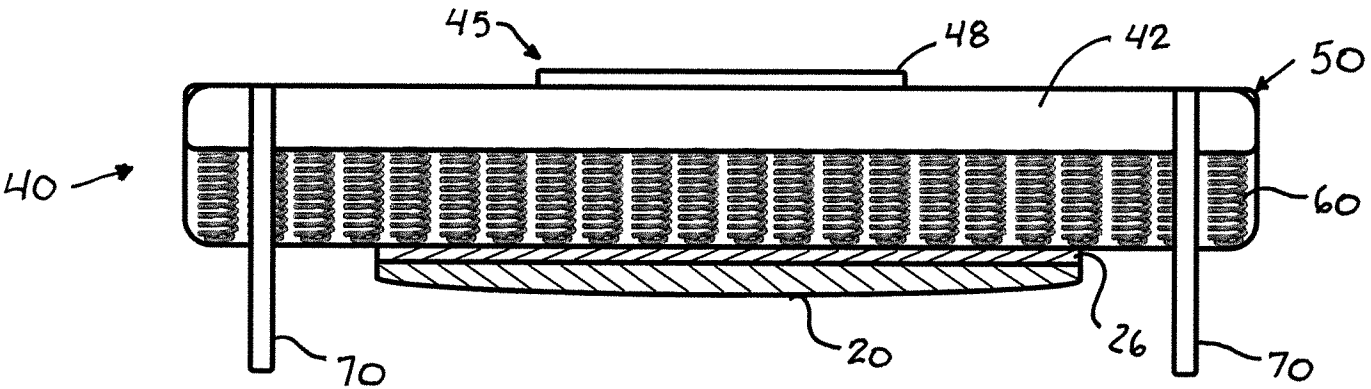
FIG. 2 is a schematic conceptual side view of a further embodiment of the present invention.
Figure 3:
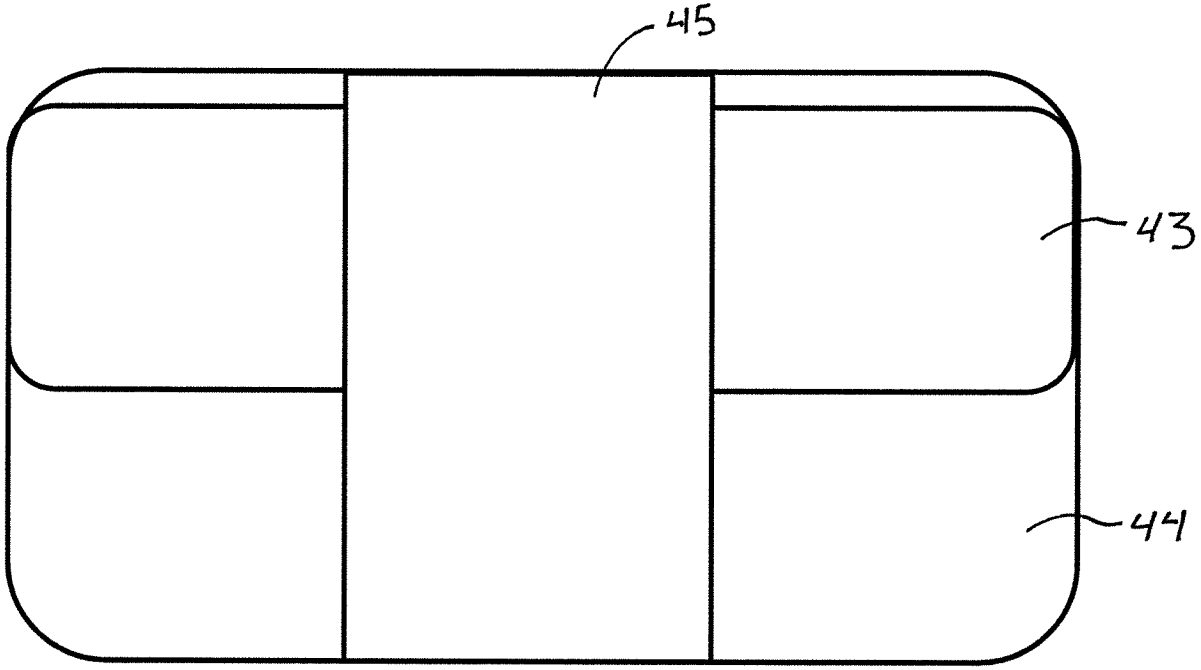
FIG. 3 is a schematic conceptual top view of the present invention.
Figure 4:
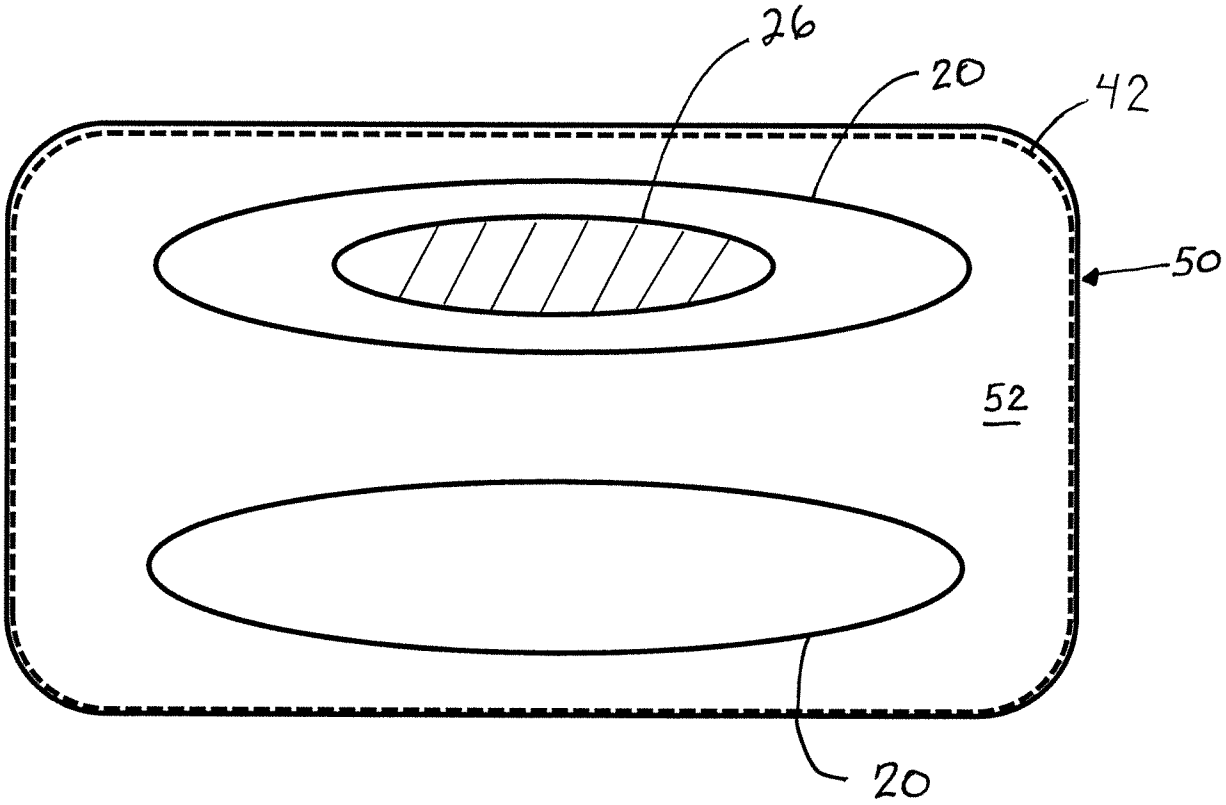
FIG. 4 is a schematic conceptual bottom view of the present invention.

With reference now to the drawings, and in particular to FIGS. 1 through 4 thereof, a new mattress restoration assembly embodying the principles and concepts of the present invention and generally designated by the reference numeral 10 will be described.

The mattress restoration assembly at its most basic includes at least one impression filling member 20, which is positioned in an impression formed in a mattress to be restored and a mattress topper assembly 40 which may be positioned on top of the mattress to be restored and the impression filling member 20.

In at least one preferred embodiment, the mattress restoration assembly 10 includes a first impression filling member 20 and a second impression filling member 26. The first impression filling member 20 may be trimmed by a user to substantially fit within and at least partially fill the impression to be filled. Preferably, the first impression filling member 20 has a thickness between 0.25 and 2 inches and more preferably is approximately 1 inch. The second impression filling member 26 may also be trimmed by a user to substantially fit within and at least partially fill the impression to be filled. Preferably, the second impression filling member 26 has a thickness between 0.25 and 2 inches and more preferably is 0.5 inches in thickness. The user may use both the first impression filling member 20 and the second impression filling member 26 to substantially fill in an impression in the mattress. Further, the user may use the first impression filling member 20 or the second impression filling member 26 individually, repetitively, or in combination as desired to fill the impressions in the mattress.

The use may affix either the first 20 or second impression filling member 26 to the mattress or to the mattress topper assembly 40 or to each other. From the perspective of maintaining warranty coverage for the mattress, it is preferable that the impression filling members 20, 26 be affixed to the mattress topper assembly 40. Typically, the impression filling members 20, 26 are affixed using an adhesive.

The present invention also contemplates the instance where a user prefers to have the impression filling members 20, 26 cut to size and affixed to the mattress topper assembly 40 by the factory, rather than performing these operations themselves. In such a case, the impression geometry needs to be determined, communicated, and utilized to produce a custom restoration assembly.

Generally, the impression filling members 20, 26 are made from poly foam, gel foam, memory foam, latex, synthetic latex, fabric pad, or thermal pad. The first 20 and second impression filling members 26 may be made from different materials or the same materials.

Similarly, the mattress topper assembly 40 may consist of one or more layers, each of which may be made from poly foam, gel foam, memory foam, latex, synthetic latex, fabric pad, or thermal pad.

In at least one embodiment, the mattress topper assembly 40 includes a main support member 42 and a main covering member 50. The main support member 42 is designed cover the top surface of the mattress to be restored. The main covering member 50 covers the top surface and a perimeter edge surface of said main support member 42.

In a further embodiment, the mattress topper assembly 40 includes multiple support members 44. Support members 44 may be oriented in longitudinally, or laterally, and may cover substantially all of the top surface of the mattress or a portion of the top surface of the mattress.

In still a further embodiment, the mattress topper assembly 40 includes a plurality of spring assemblies 60 positioned in a spaced array along a length of the assembly 40 and either along approximately one half of the width of the assembly 40 or along substantially the whole width of the assembly 40. Generally the plurality of spring assemblies 60 is positioned underneath the main support member.

In yet a further embodiment, the mattress topper assembly 40 also includes a lumbar support member 46, which generally runs laterally along a central third of the mattress topper assembly 40.

In still a further embodiment, the mattress topper assembly 40 includes a hip support member 48, which generally runs laterally along a central third of the mattress topper 40. The hip support member 48 is generally positioned substantially above the main support member 42.

The mattress topper assembly 40 may also include a lower cover member 52 designed to abut the top surface of the mattress and operationally coupled to the main covering member 50.

The mattress restoration assembly 10 may also described in terms of filling support zones defined in the mattress without diverging from the present invention. One such embodiment, described in terms of support zones may be described as follows. Such an embodiment may include a plurality of longitudinal support members 43. Each one of the longitudinal support members 43 is uniquely associated with a longitudinal support zone of the mattress where additional support is desired. Each one of said plurality of longitudinal support members 43 comprises a material selected from the group of materials consisting of poly foam, gel foam, memory foam, latex, synthetic latex, fabric pad, and thermal pad. Each one of the plurality of longitudinal support members 46 comprises a material with an indentation load deflection coefficient corresponding to an amount of support and firmness desired for the associated longitudinal support zone. Such an embodiment may also include at least one lateral support member 45. Each lateral support member 45 is uniquely associated with a lateral support zone of the mattress where additional support is desired.

An illustrative example of a lateral support member 45 is a support member 44 designed to provide lumbar support and is positioned substantially at a center third of the mattress.

Another illustrative example of a lateral support member 45 is designed to provide hip support and is positioned substantially at a center third of the mattress and provides an increase in height of the mattress restoration assembly.

The lateral support zones and longitudinal support zones may overlap and lateral support members 45 and longitudinal support members 43 may overlap each other.

In at least one embodiment, the mattress restoration assembly 10 also includes a securing means 70 selected from the group of restoration securing means consisting of a drawstring extending around a lower perimeter of the restoration assembly, at least one elastic member extending around the lower perimeter of the restoration assembly, a plurality of strap members 74 extending outwardly from the restoration assembly and positionable under the mattress, and at least one portion of hook and loop fastener 75. FIG. 1 indicates the securing means (70) along with implementations of either the elastic member or drawstring as shown by reference number 72, a strap member as shown by reference number 74 and a portion of hook and loop fastener as shown by reference item 75. Each of these securing means may be used individually.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

INDEX OF ELEMENTS FOR MATTRESS RESTORATION ASSEMBLY

10. MATTRESS RESTORATION ASSEMBLY
11.
12.
13.
14.
15.
16.
17.
18.
19.
20. First Impression Filling Member
21.

22.
23.
24.
25.
26. Second Impression Filling Member
27.
28.
29.
30.
31.
32.
33.
34.
35.
36.
37.
38.
39.
40. Topper Assembly
41.
42. Main Support Member
43. Longitudinal Support Member
44. Support Members
45. Lateral Support Member
46. Lumbar Support Member
47.
48. Hip Support Member
49.
50. Main Covering Member
51.
52. Lower Cover Member
53.
54.
55.
56.
57.
58.
59.
60. Spring Assemblies
61.
62.
63.
64.
65.
66.
67.
68.
69.
70. Securing Means
71.
72.
73.
74.
75.
76.
77.
78.
79.

I claim:

1. A Mattress Restoration Assembly comprising:

a mattress abutting cover member positionable on a mattress to be restored;

at least one support member operationally coupleable to said mattress abutting cover member;

a top cover member positionable over said mattress abutting cover member and said at least one support member; and a securing means operationally coupled to said mattress abutting cover member for selectively securing said mattress restoration assembly to the mattress a plurality of longitudinal support members, each one of said longitudinal support members being uniquely associated with a longitudinal support zone of the mattress where additional support is desires;

wherein each one of said plurality of longitudinal support members comprises a material selected from the group of materials consisting of ploy foam, gel foam, memory foam, latex, synthetic latex, fabric pad, and thermal pad;

wherein each one of said plurality of longitudinal support members comprises a material with an indentation load deflection coefficient corresponding to an amount of support and firmness desired for the associated longitudinal support zone;

at least one lateral support member, each one of said lateral support members being uniquely associated with a lateral support zone of the mattress where additional support is desired;

wherein said at least one lateral support member is adapted to provide lumbar support and is positioned substantially at a center third of the mattress;

wherein said at least one lateral support member is adapted to provide hip support and is positioned substantially at a center third of the mattress and provides an increase in height of said mattress restoration assembly;

wherein lateral support zones and longitudinal support zones may overlap and lateral support members and longitudinal support members may overlap each other; and wherein said securing means comprises a securing means selected from the group of restoration securing means consisting of a drawstring extending around a lower perimeter of said restoration assembly, at least one elastic member extending around said lower perimeter of said restoration assembly, a plurality of strap members extending outwardly from said restoration assembly and positionable under the mattress, and at least one portion of hook and loop fastener.

2. A method of restoring a mattress comprising the steps of:

Inspecting a mattress to be repaired;

Defining at least one zone for restoration;

Identifying an amount of support desired for said at least one zone for restoration;

Providing at least one support member;

Providing a mattress abutting cover member;

Operationally coupling said at least one support member to said mattress abutting cover member substantially aligned with said at least one zone for restoration;

Providing a top covering member;

Operationally coupling said top cover member to said mattress abutting cover member substantially enclosing said at least one support member forming a restoration assembly;

Operationally coupling said restoration assembly to the mattress;

wherein said step of operationally coupling said restoration assembly to the mattress further comprises the steps of:

providing a restoration assembly securing means selected from the group of restoration securing means consisting of a drawstring extending around a lower perimeter of said restoration assembly, at least one elastic member extending around said lower perimeter of said restoration assembly, a plurality of strap members extending outwardly from said restoration assembly and positionable under the mattress, and at least one portion of hook and loop fastener; and aligning said restoration assembly on the mattress such that each support member is substantially aligned with its uniquely associated zone; and securing said restoration assembly at least temporarily to the mattress using said securing means.

3. The method of claim 2, wherein said step of inspecting a mattress further comprising:

Determining a top plane substantially coexistent with an upper surface of the mattress;

Identifying at least one permanent or semi-permanent depression in the mattress; and Defining a geometry uniquely associated with each one of said at least one permanent or semi-permanent depressions.

4. The method of claim 3, wherein said step of defining a geometry further comprises determining a three axis approximation of the at least one permanent or semi-permanent depression, said three axis approximation including longitudinal, lateral, and depth components and; said depth component being such that said at least support member having a top surface substantially coplanar with said top plane.

5. The method of claim 2, wherein said step of defining at least one zone for restoration further comprises defining a plurality of longitudinal support zones.

6. The method of claim 2, wherein said step of defining at least one zone for restoration further comprises defining at least one lateral support zone.

7. The method of claim 2, further comprising:

wherein said step of inspecting a mattress further comprising:

Determining a top plane substantially coexistent with an upper surface of the mattress;

Identifying at least one permanent or semi-permanent depression in the mattress;

Defining a geometry uniquely associated with each one of said at least one permanent or semi-permanent depressions;

wherein said step of defining a geometry further comprises:

determining a three axis approximation of the at least one permanent or semi-permanent depression, said three axis approximation including longitudinal, lateral, and depth components;

Said depth component being such that said at least support member having a top surface substantially coplanar with said top plane;

wherein said step of defining at least one zone for restoration further comprises defining a plurality of longitudinal support zones;

wherein said step of defining at least one zone for restoration further comprises defining at least one lateral support zone; and wherein said step of providing at least one support member further comprises providing a plurality of support members, each support member being uniquely associated with one of said plurality of longitudinal support zones or said at least one lateral support zone, each one of said plurality of support members having an indentation load deflection coefficient corresponding to said amount of support identified for said lateral support zone or said lateral support zone, each one of said plurality of support members having a form factor approximating said associated geometry.

8. The method of claim 7, wherein said step of providing at least one support member further comprises the step of determining if hip support is desired for one or more users of the mattress and providing one or more hip support member for a lateral support zone which extends above the top plane if such hip support is desired.

9. The method of claim 7, wherein said step of providing at least one support member further comprises the step of determining if lumbar support is desired for one or more users of the mattress and providing one or more lumbar support member for a lateral support zone if such lumbar support is desired.

10. The method of claim 2, wherein said step of providing at least one support member further comprises providing a thermal pad layer to provide additional firmness.

11. The method of claim 2, wherein said step of providing at least one support member further comprises the step of providing at least one support member consisting of layer of latex or synthetic latex for added cushioning and limited vertical deflection.

* * * * *